US006250570B1

(12) United States Patent
Starr et al.

(10) Patent No.: US 6,250,570 B1
(45) Date of Patent: Jun. 26, 2001

(54) VARIABLE PATTERN NOZZLE

(75) Inventors: Joseph W. Starr, Burbank; Alan S. Robinson, El Monte, both of CA (US)

(73) Assignee: Technifex, Inc., Valencia, CA (US)

( * ) Notice: Subject to any disclaimer, the term of this patent is extended or adjusted under 35 U.S.C. 154(b) by 0 days.

(21) Appl. No.: 09/546,066

(22) Filed: Apr. 10, 2000

(51) Int. Cl.[7] ..... B05B 1/34; B05B 17/08
(52) U.S. Cl. ..... 239/472; 239/17
(58) Field of Search ..... 239/17, 18, 20, 239/472, 473, 470, 463, 461

(56) References Cited

U.S. PATENT DOCUMENTS 3,558,053 * 1/1971 Hruby, Jr. ..... 239/17
3,645,449 * 2/1972 Hruby, Jr. ..... 239/17
3,773,258 * 11/1973 Hruby, Jr. ..... 239/17
3,782,629 1/1974 Hruby, Jr. ..... 239/17

* cited by examiner

*Primary Examiner*—Lesley D. Morris
(74) *Attorney, Agent, or Firm*—Holme Roberts & Owen LLP; Christopher J. Kulish

(57) ABSTRACT

The present invention provides a nozzle assembly for producing varying water patterns. In one embodiment, a variable first flow of water is constrained to flow in a linear direction. A variable second flow of water is applied to the first flow of water to impart a twist to the first flow of water. The resulting flow of water has a height component that is largely determined by the first flow of water and a lateral component that is largely determined by the second flow of water. For example, if there is only a first flow and no second flow, the resulting water effect is a narrow column of water. If there is no first flow and a second flow, the resulting water effect is a cone with a small vertical dimension. If there are both first and second flows, a cone is produced with a vertical dimension that is largely determined by the first flow and a lateral dimension that is largely determined by the second flow.

24 Claims, 3 Drawing Sheets

VARIABLE PATTERN NOZZLE

FIELD OF THE INVENTION

The present invention is directed to a water nozzle assembly for producing variable water patterns.

BACKGROUND OF THE INVENTION

There are several types of water nozzles that provide the ability to vary the pattern of the discharged water. For example, the typical fire hose nozzle provides the operator with ability to produce a discharge of water with a pattern that can be varied between a relatively thin stream of water and a wide conical spray. The operator controls the pattern by actuating a lever that, in turn, varies the position of a plug within the nozzle.

Another type of nozzle permits the pattern of the discharge pattern to be only one of either a relatively thin stream of water or a wide conical spray. The relatively thin stream of water is produced by supplying water to the first of two pairs of inlet ports to the nozzle, while not providing any water to the second pair of inlet ports. To produce the wide conical spray, water is provided to the second pair of inlet ports but not to the first pair of inlet ports.

SUMMARY OF THE INVENTION

The present invention is directed to a nozzle assembly that permits the discharge pattern of the water to be varied between a relatively thin stream of water and a wide conical spray of water without the use of any moving parts within the nozzle.

In one embodiment, the nozzle assembly includes a hollow body for carrying a first stream of water in a straight or linear direction. A tangential injector is provided for carrying a second stream of water and directing the stream such that it has a spin or rotational component. The tangential injector is operatively connected to the hollow cylindrical body so that whatever first and second streams of water are present intersect and interact with one another to produce a third stream of water. A nozzle is provided for receiving the third stream of water and directing the stream of water to an exit orifice.

In operation, the pattern of the water produced at the orifice can be varied between a thin stream and a wide conical shape by varying the water supplied to the hollow body and the tangential injector. At one extreme, if a stream of water is supplied to the hollow body but no water is provided to the tangential injector, a relatively thin stream of water exits the orifice. If, however, a stream of water is supplied to the tangential injector but no water is provided to the hollow body, a wide conical spray is produced at the orifice. By providing streams of water to both the hollow body and the tangential injector, a discharge pattern that is between the thin stream of water and the wide conical spray is produced. By varying the characteristics of the streams, the resulting discharge pattern can be varied. More specifically, increasing the pressure of the first stream being provided to the hollow body increases the vertical or longitudinal component of the resulting discharge pattern. In contrast, increasing the pressure of the second stream of water being provided to the tangential diffuser increases the breadth or radial component of the resulting conical spray pattern.

In one embodiment, the hollow body includes a flow straightening device to insure that any spin or twist in the water received by the body is removed prior to interaction with any water provided by the tangential injector assembly. This insures that any twist or spin in the water discharged from the nozzle is substantially attributable to the effect of any water being provided by the tangential injector. If no water is provided by the tangential injector, the stream of water that is discharged from the nozzle assembly has a glass-like quality. Further, in one embodiment, the discharged stream of water is both glass-like and substantially solid.

In a further embodiment, the tangential injector includes a diffuser with a plurality of holes. The holes of the diffuser receive the second stream of water and constrain the path of the second stream of water such that the exiting stream has the desired rotational characteristics. Employing more than two holes aids in the reduction of any artifact in the discharge pattern that is indicative of the use of a rotating stream of water to achieve a conical discharge pattern. Equal spacing of the holes further reduces any such artifact.

In another embodiment, the tangential injector includes a housing that defines a plenum for the second stream of water. The housing includes an inlet port for receiving the second stream of water and a tangential diffuser that directs the second stream of water to interact with the first stream of water. The plenum is of sufficient size to assure that there is substantially equal pressure at the entry to each of the holes. Substantially equal pressure improves the quality of the spin or twist produced in the third stream of water that is discharged from the nozzle.

The housing, in one embodiment, has a torus shape and an inlet port that directs the second stream of water such that the stream has a tangential component relative to radius of the torus-shaped housing. The tangential orientation of the inlet port and the torus shape of the plenum enhance the spin or rotational quality of the second stream of water and thereby substantially prevent any random turbulence in the stream of water received at the inlet port from reaching the tangential diffuser. This, in turn, facilitates the equalization of the hydraulic conditions at the entry to each of the holes in the diffuser and the quality of the resulting discharge pattern.

Another embodiment employs a nozzle that is shaped to increase the centripetal velocity of any rotational or spin component in the third stream of water. In one embodiment, a nozzle with a U-shaped longitudinal cross-section is utilized to achieve this effect.

DETAILED DESCRIPTION

Generally, the present invention is directed to a nozzle assembly that operates to mix a first stream of water that is flowing in a linear direction with a second stream of water that is rotating about an axis to produce a third stream of water for discharge to the exterior environment that has a pattern which is determined by the characteristics of the first and second streams of water. By varying the characteristics of the first and second streams of water, the pattern of the water discharged from the nozzle assembly can be varied.

Figure 2:
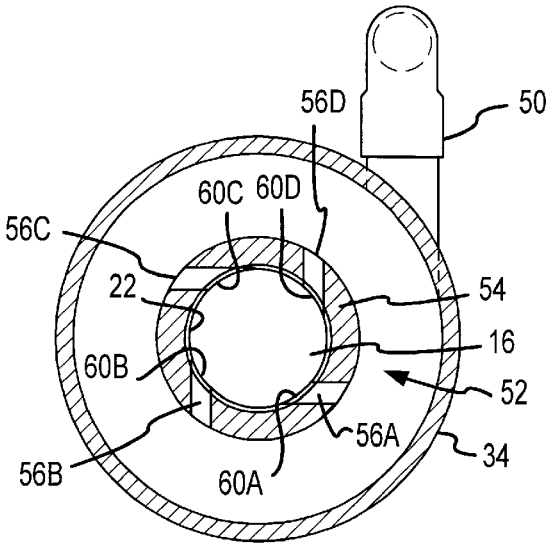
FIG. 2 is a horizontal cross-sectional view of the tangential injector portion of the embodiment of the nozzle illustrated in FIG. 1.
Figure 1:
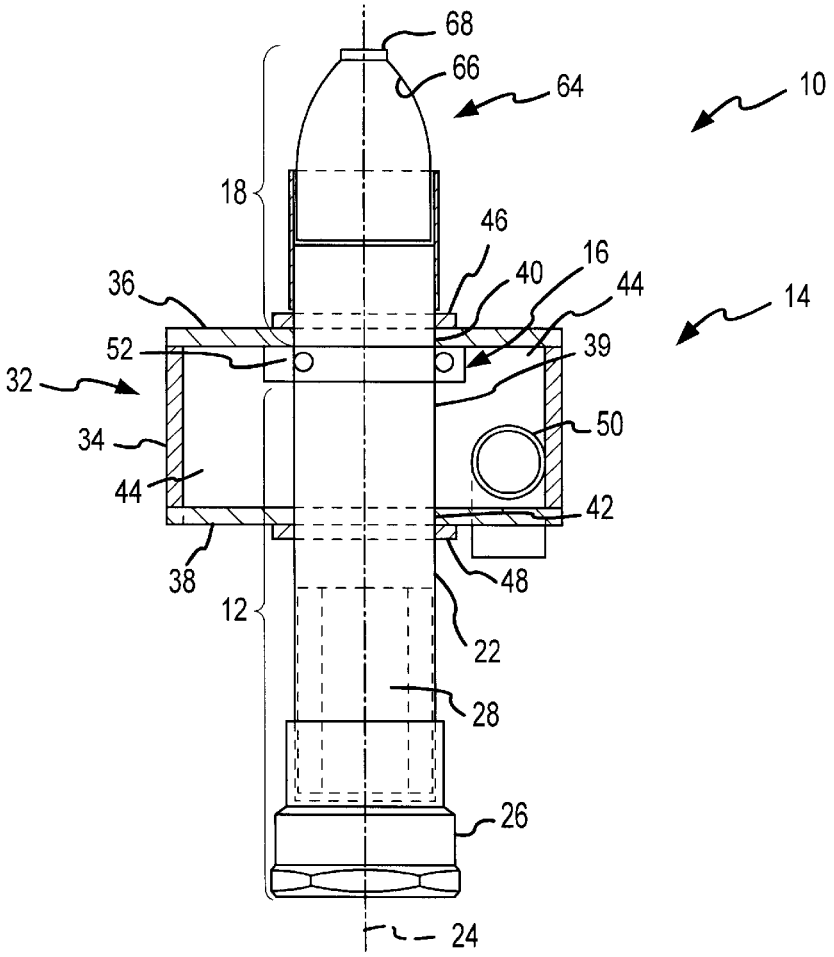
FIG. 1 is a plan view of one embodiment of the nozzle of the present invention with cross-sections of the tangential diffuser and nozzle tip.

With reference to FIGS. 1 and 2, a nozzle assembly 10 is illustrated that represents an embodiment of the invention. Generally, the nozzle assembly 10 includes first section 12 for receiving a first stream of water and directing the first stream along a linear path; a tangential injector 14 for receiving a second stream of water and directing the second stream of water such that the stream turns about a rotational axis; a second section 16 for bringing together the first and second streams of water; and a third section 18 for providing the third stream of water to the exterior environment with a pattern that is dictated by characteristics associated with the first and second streams of water.

The first section 12 includes a cylindrical tube 22 with a longitudinal axis 24. Attached to one end of the cylindrical tube 22 is a threaded coupler 26 for attaching the nozzle to the plumbing that is capable of providing the first stream of water. Other types of coupling devices are also feasible. Also associated with the first section 12 is a flow straightening device 28 that is located within the cylindrical tube 22 and operates to remove rotation or twist in the first stream of water. The flow straightening device 28 is an array of parallel tubes. However, other flow straightening devices are feasible.

The tangential injector 14 includes a torus-shaped housing 32 with a cylindrical outer wall 34, a circular upper wall 36, a circular lower wall 38 and a portion 39 of the cylindrical tube 22. The circular upper wall 36 includes a first hole 40, and the circular lower wall 38 includes a second hole 42 that is aligned with the first hole 40. The first and second holes 40, 42 allow the circular upper wall 36 and the circular lower wall 38 of the housing 32 to be fitted or slid over the cylindrical tube 22 during assembly. The housing 32 defines a plenum chamber 44 for the second stream of water. The upper wall 36 and lower wall 38 are attached to the cylindrical tube 22 in a water-tight manner with first and second fasteners 46, 48. When metal components are used, the first and second fasteners 46, 48 are typically welds. Adhesives are generally used to form the first and second fasteners 46, 48 when the components are plastic. Other types of fasteners are feasible.

The tangential injector 14 also includes an inlet port 50 for directing the second stream of water into the plenum chamber 44. The inlet port 50 is located to direct the second stream of water into the plenum chamber 44 in a direction that is substantially tangential or perpendicular to the radius of the cylindrical outer wall of the chamber 34.

Further included in the tangential injector 14 is a tangential diffuser 52 for directing the second stream of water, immediately before it is mixed with the first stream of water, so that the stream rotates about a rotational axis. In this embodiment, the rotational axis coincides with the longitudinal axis 24 along which the first stream of water is moving. The tangential diffuser 52 includes a collar 54 with holes 56A–56D that direct the second stream of water to rotate about the rotational axis. Each of the holes 56A–56D includes an entry port for receiving a portion of the second stream of water and an exit port that is aligned with a hole in the tube 22. The tangential diffuser 52 is attached to the circular upper wall 36 of the chamber 32 by an appropriate fastener.

The second section 16 is the portion of the cylindrical tube 22 at which the first stream of water carried by the first section 12 and the second stream of water provided by the tangential injector 14 are mixed to form the third stream of water. The second portion 16 includes the portion of cylindrical tube 22 with holes 60A–60D that are aligned with the holes 56A–56D of the tangential diffuser.

The third section 18 receives the third stream of water produced by the mixing of the first and second streams of water by the second section 16. The third section 18 includes a portion of the cylindrical tube 22 and a nozzle tip 64 that is joined to the cylindrical tube by an appropriate fastener. The nozzle tip 64 includes an inner surface 66 and an orifice 68 for directing the third stream of water into the exterior environment. The inner surface 66 has a longitudinal cross-section that tapers towards the orifice 68. In the illustrated embodiment, the longitudinal cross-section is U-shaped or V-shaped. By having the inner surface 66 taper towards the orifice any rotational component in the third stream of water is accelerated to make the resulting spray pattern have a broader or wider conical shape than it would have otherwise.

Figure 3A:
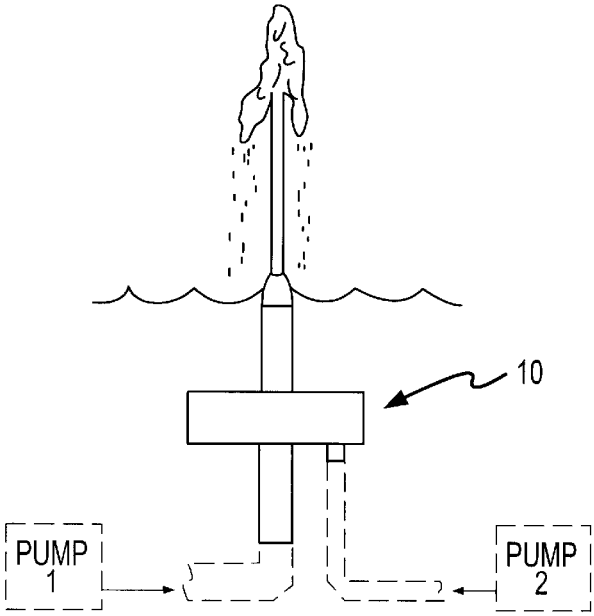
FIG. 3A illustrates the relatively thin discharge pattern that is produced when water, at first pressure, is only applied to the first inlet port.
Figure 3B:
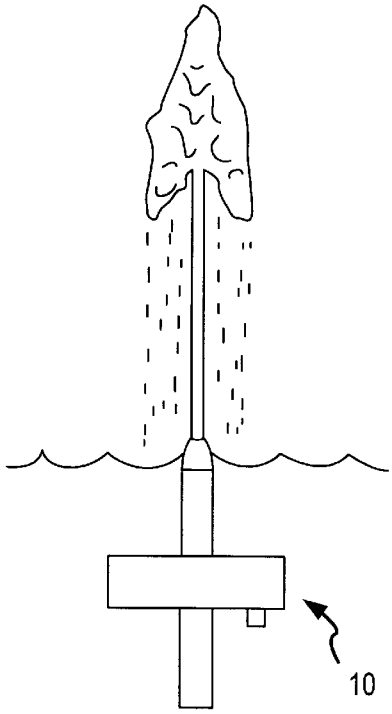
FIG. 3B illustrates the relatively thin discharge pattern that is produced when water, at a second pressure that is greater than the first pressure noted with respect to FIG. 3A , is only applied to the first inlet port.

With reference to FIGS. 3A–3F, the operation of the nozzle 10 is described. The nozzle 10 is capable of producing a spray that can be varied based upon the characteristics of the two streams of water that can be applied to the nozzle assembly 10. When a first stream of water is applied to the first section 12 but no water is supplied to the tangential injector 14, the third stream of water ejected from the orifice 68 is a relatively thin stream of water as shown in FIG. 3A. In this case, the first stream of water is provided to the first section 12 initially passes through the flow straightening device 28 to remove rotation or twist in the stream. The first stream of water passes through the second section 16 of the assembly substantially unaffected due to the lack of a second stream of water. Due to the lack of any rotational component, the third stream of water exiting the second section 16 (which is equivalent to the first stream of water in this case) passes through the third section 18 substantially unaffected and exits the orifice 68 as a relatively thin stream of water. Due to the operation of the flow straightener 28, the exiting stream of water is also highly laminar and, as a consequence, has a glass-like quality. Further, the exiting stream is a substantially solid stream of water. As illustrated in FIG. 3B, increasing the pressure of the first stream of water applied to the nozzle assembly 10 increases the height or length of the thin stream of water exiting the orifice 68.

Figure 3C:
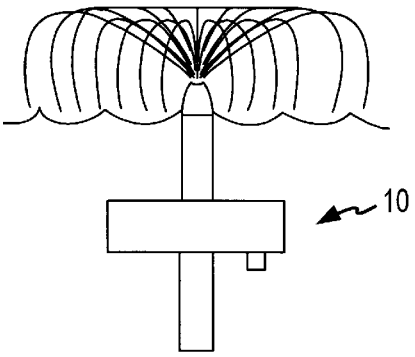
FIG. 3C illustrates the wide conical spray pattern that is produced when water, at a first pressure, is only applied to the second inlet port.
Figure 3D:
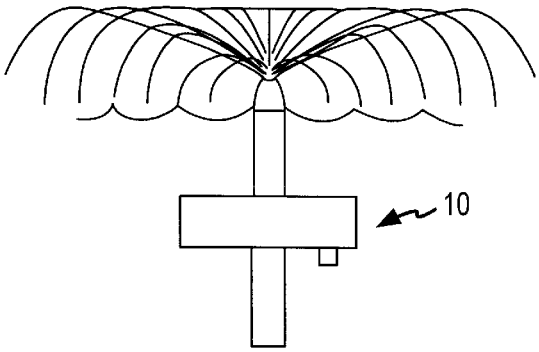
FIG. 3D illustrates the wide conical spray pattern that is produced when water, at a second pressure that is greater than the first pressure noted with respect to FIG. 3C, is only applied to the second inlet port.
Figure 3E:
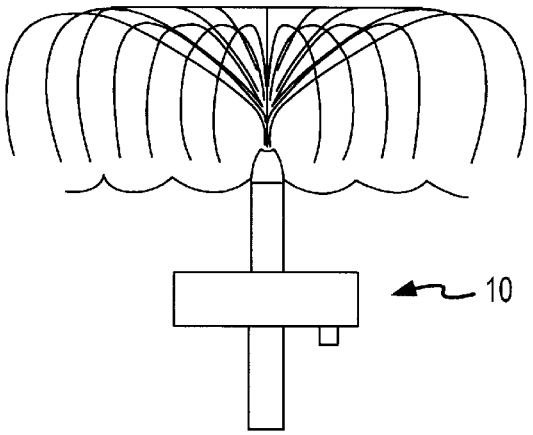
FIG. 3E illustrates an intermediate conical spray pattern that is produced when water is applied to both the first and second inlet ports at first pressures.
Figure 3F:
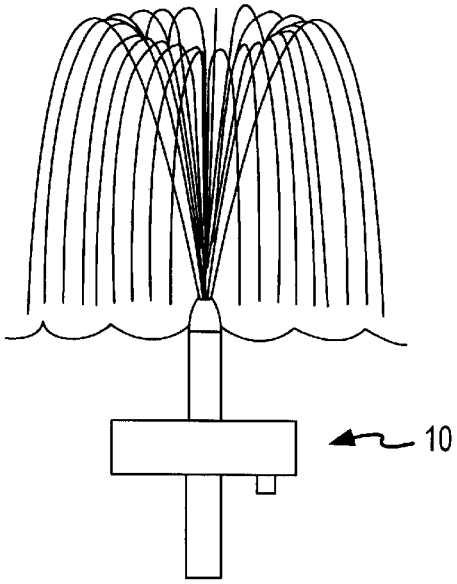
FIG. 3F illustrates an intermediate conical spray pattern that is produced when water is applied to both the first and second inlet ports at second pressures that are greater than the first pressures noted with respect to FIG. 3E.

When a second stream of water is applied to the tangential injector 14 but no water is supplied to the first section 12, the resulting third stream of water ejected from the orifice 68 has a broad conical pattern as shown in FIG. 3C. In this case, the second stream of water is injected into the housing 32 by the inlet port 50. The tangential injection of the second stream of water by the inlet port 50 and the cylindrical outer wall 34 cooperate to create a circular flow that reduces random turbulence in the water and aids in reducing any differences in the hydraulic conditions existing at the entry ports to each of the holes 56A–56D of the tangential diffuser 52. Further, the size of the plenum 44 is chosen so as to reduce differences in the water pressure present at the entry ports of each of the holes 56A–56D of the tangential diffuser 52. The second stream of water passes through the holes 56A–56D and enters the second section 16 with a rotation or spin that is substantially centered about the longitudinal axis 24. Since there is not a first stream of water, the third stream of water output by the second section 12 is composed solely of the second stream of water provided by the tangential diffuser 52. The third stream of water is applied to the third section 18 of the assembly. Due to the rotational aspect of the third stream of water, the inner surface 66 of the nozzle 64 causes the rotational velocity of the third stream of water to increase as the water nears the orifice 68. As a consequence, the spray output by the orifice 68 has a wider or broader conical pattern than it would otherwise. As shown in FIG. 3D, increasing the pressure of the second stream of water applied to the nozzle assembly 10 increases the width or breadth of the conical pattern.

When both first and second streams of water are applied to the nozzle assembly 10, the resulting stream of water discharged from the orifice 68 has a height or length that is largely defined by the pressure associated with the first stream of water and a conical shape that is largely determined by the pressure associated with the second stream of water. By adjusting the pressures of the first and second streams of water an infinite number of spray patterns can be achieved that are roughly within a cylindrical envelope having a height defined by the maximum pressure that can be applied to the first stream and a conical breadth defined by the maximum pressure that can be applied to the second stream. Further, the water pumps providing the first and second stream of water can be controlled so as to produce a spray pattern that changes over time. Further, the water pumps that are supplying water to several of the nozzle assembly 10 can be controlled to produce a plurality of spray patterns that change over time.

Several variations in the design of the nozzle assembly 10 are possible. For example, instead of using a portion of the cylindrical tube 22 to define the first and second sections 12, 16, the interior surface of a tangential diffuser can define the second section. In this case, separate tubes would be used in the first and third sections of the nozzle assembly 10. Another possible modification is to implement the tangential injector with the tangential diffuser receiving the second stream of water from separate lines. Yet another possible modification is change the angle at which the tangential diffuser injects the second stream of water into the second section. In the illustrated embodiment, the second stream of water is injected substantially perpendicular to the radius of the cylindrical tube, i.e., in a tangential fashion. It is possible to inject the second stream of water into the second section at an angle that has a radial component, provided there is still a tangential component. Furthermore, the angle of injection can be tipped. To elaborate, the tangential diffuser 52 injects the second stream of water into the second section 16 through holes 56A–56D that lie in a plane that is substantially perpendicular to the longitudinal axis 24. The second stream can be injected into the second section at an angle to the noted perpendicular plane, provided there is still a tangential or rotational component to the second stream.

The foregoing description of the invention has been presented for purposes of illustration and description. Further, the description is not intended to limit the invention to the form disclosed herein. Consequently, variation and modifications commensurate with the above teachings, and the skill or knowledge in the relevant art are within the scope of the present invention. The preferred embodiment described hereinabove is further intended to explain the best mode known of practicing the invention and to enable others skilled in the art to utilize the invention in various embodiments and with the various modifications required by their particular applications or uses of the invention. It is intended that the appended claims be construed to include alternate embodiments to the extent permitted by the prior art.

What is claimed is:

1. A nozzle assembly that is capable of producing a variable water pattern comprising:

a first hollow section for receiving a first stream of water and providing a linear stream of water that is moving along a linear axis;

a second hollow section for receiving a second stream of water and providing a rotating stream of water that rotates about a rotational axis;

a third hollow section for receiving the linear stream of water and the rotating stream of water such that the linear axis and the rotational axis are non-perpendicular and providing a third stream of water formed by the linear stream of water and the rotating stream of water; and a nozzle for receiving the third stream of water and directing the third stream of water into the exterior environment by an orifice.

2. A nozzle assembly, as claimed in claim 1, wherein:

said first hollow section includes a flow straightener for removing rotation present in the first stream of water.

3. A nozzle assembly, as claimed in claim 1, wherein:

said second hollow section includes a tangential diffuser that includes a plurality of passages for directing the second stream of water about the rotational axis.

4. A nozzle assembly, as claimed in claim 3, wherein:

said plurality of passages includes more than two passages.

5. A nozzle assembly, as claimed in claim 3, wherein:

said plurality of passages having a plurality of exit ports that are arranged in a circle and with substantially equal spacing between exit ports that are immediately adjacent to one another.

6. A nozzle assembly, as claimed in claim 1, wherein:

said second hollow section includes a plenum with an inlet port for receiving the second stream of water and a tangential diffuser.

7. A nozzle assembly, as claimed in claim 1, wherein:

said second hollow section includes:

a plenum with a torus shape that has an outer radius; and an inlet port;

wherein said inlet port is located to direct at least a portion of the second stream of water such that the second stream of water has a tangential component relative to said outer radius.

8. A nozzle assembly, as claimed in claim 1, wherein:

said nozzle has an interior surface with a longitudinal cross-section that is one of the following: U-shaped and V-shaped.

9. A nozzle assembly, as claimed in claim 1, wherein:

said nozzle has a nozzle interior surface with lateral cross-sections of decreasing lateral dimension closer to said orifice.

10. A nozzle assembly, as claimed in claim 1, wherein:

said nozzle has interior surface that is flat.

11. A nozzle assembly that is capable of producing a variable water pattern comprising:

a first hollow cylindrical section for receiving a first stream of water and directing the first stream of water in the direction of a longitudinal axis of said first hollow cylindrical body;

a tangential injector for receiving a second stream of water and directing a second stream of water to rotate about a rotational axis using at least one passageway;

a second hollow cylindrical section for receiving the first stream of water flowing in the direction of said longitudinal axis from the first hollow cylindrical body and the second stream of water rotating about said rotational axis from said tangential injector such that said rotational axis is other than perpendicular to said longitudinal axis, and providing a third stream of water formed from the first and second streams of water; and a third hollow section for receiving the third stream of water and directing the third stream of water to the exterior environment.

12. A nozzle assembly, as claimed in claim 11, wherein:

said first hollow cylindrical section includes a flow straightener.

13. A nozzle assembly, as claimed in claim 11, wherein:

said first hollow cylindrical section and said second hollow cylindrical section are made from the same piece of material.

14. A nozzle assembly, as claimed in claim 11, wherein:

said second hollow cylindrical section and at least a portion of said third hollow section are made from the same piece of material.

15. A nozzle assembly, as claimed in claim 11, wherein:

said first hollow cylindrical section, said second hollow cylindrical section and at least a portion of said third hollow section are made from the same piece of material.

16. A nozzle assembly, as claimed in claim 15, wherein:

said portion of said third hollow section is cylindrical.

17. A nozzle assembly, as claimed in claim 11, wherein:

said second hollow cylindrical section includes a hole for receiving the second stream of water from said tangential injector.

18. A nozzle assembly, as claimed in claim 11, wherein:

said second hollow cylindrical section is defined by a surface of said tangential injector.

19. A nozzle assembly, as claimed in claim 11, wherein:

a portion of said third hollow section has a longitudinal cross-section that is one of the following: U-shaped and V-shaped.

20. A nozzle assembly, as claimed in claim 11, wherein:

said longitudinal axis and said rotational axis are substantially coincident.

21. A method for producing a variable water pattern, the method comprising:

selectively providing a first stream of water to a first end of a cylindrical tube;

selectively providing a second stream of water to a structure for causing said second stream of water to rotate about a rotational axis;

merging said first stream of water with said second stream of water such that said longitudinal axis of said tube is other than perpendicular to said rotational axis of said second stream of water, said first and second streams of water forming a third stream of water; providing said third stream of water to the exterior environment.

22. A method, as claimed in claim 21, wherein:

said step of selectively providing a first stream of water includes varying the volume of said first stream of water provided over time to change the height of said third stream of water.

23. A method, as claimed in claim 21, wherein:

said step of selectively providing a second stream of water includes varying said volume of said second stream of water provided over time to change the lateral dispersion of said third stream of water.

24. A method, as claimed in claim 21, wherein:

said steps of selectively providing a second stream of water includes varying the volume of said second stream of water during at least a portion of the same period of time as said step of varying said first volume of water.

* * * * *